US008066131B2

(12) United States Patent
Mansor et al.

(10) Patent No.: US 8,066,131 B2
(45) Date of Patent: Nov. 29, 2011

(54) MODULAR OVERHEAD STORAGE SYSTEM

(76) Inventors: Todd Mansor, Phoenix, AZ (US); Jeff Moffat, Palm Desert, CA (US)

( * ) Notice: Subject to any disclaimer, the term of this patent is extended or adjusted under 35 U.S.C. 154(b) by 0 days.

(21) Appl. No.: 12/972,278

(22) Filed: Dec. 17, 2010

(65) Prior Publication Data

US 2011/0198307 A1 Aug. 18, 2011

Related U.S. Application Data

(63) Continuation of application No. 12/770,279, filed on Apr. 29, 2010, now abandoned.

(60) Provisional application No. 61/174,427, filed on Apr. 30, 2009.

(51) Int. Cl.
*A47F 5/08* (2006.01)

(52) U.S. Cl. ..... 211/117; 211/175

(58) Field of Classification Search ..... 211/117, 211/113, 118, 119, 175, 189, 207, 208, 181.1; 108/48, 42, 149, 186; 52/39; 248/317, 323, 248/326, 327, 343

See application file for complete search history.

(56) References Cited

U.S. PATENT DOCUMENTS

| | | | | | |
|---|---|---|---|---|---|
| 2,057,092 | A * | 10/1936 | Geib | 182/113 |
| 3,139,045 | A * | 6/1964 | Rojakovick | 108/109 |
| 3,735,951 | A * | 5/1973 | Reed | 248/340 |
| 6,145,678 | A * | 11/2000 | Morrison | 211/113 |
| D459,926 | S * | 7/2002 | Mikich et al. | D6/513 |
| 6,435,105 | B1 * | 8/2002 | Mikich et al. | 108/42 |
| 6,715,427 | B2 * | 4/2004 | Mikich et al. | 108/42 |
| 6,725,608 | B1 * | 4/2004 | Kraus | 52/36.4 |
| 7,357,262 | B2 * | 4/2008 | Fratilla | 211/117 |
| 7,543,538 | B2 * | 6/2009 | Baez | 108/42 |
| 7,810,438 | B2 * | 10/2010 | Ryberg | 108/42 |
| 2004/0182291 | A1 * | 9/2004 | Mikich et al. | 108/149 |
| 2006/0070967 | A1 * | 4/2006 | Schaubeck et al. | 211/187 |
| 2007/0007223 | A1 * | 1/2007 | Thrush et al. | 211/118 |
| 2007/0119805 | A1 * | 5/2007 | Nawrocki | 211/119 |
| 2007/0205169 | A1 * | 9/2007 | Fratilla | 211/117 |

* cited by examiner

*Primary Examiner* — Jennifer E. Novosad

(57) ABSTRACT

An overhead rack system is provided that may be mounted to the ceiling of a structure such as a garage for storing items in an organized manner off the floor. The overhead rack system includes a first and second adjustable mounting track and a support surface having a number of side rails connected together by a plurality of rail connectors. The first and second adjustable mounting tracks are adjustable relative to the ceiling mount such that the space between the ceiling and the support surface as well as the overall length of the side rails may be adjusted by the user according to the intended space.

1 Claim, 11 Drawing Sheets

MODULAR OVERHEAD STORAGE SYSTEM

RELATED APPLICATIONS

This applications claims priority from U.S. Provisional Application No. 61/174,427, filed Apr. 30, 2009, which is hereby incorporated by reference.

FIELD OF THE INVENTION

The present invention is directed to overhead storage products that utilize unused ceiling space to create additional storage in homes. More specifically, the present invention is directed to a modular overhead storage system that utilizes an adjustable mounting track for supporting a side rail that may be sized to fit a particular construction using a rail connector.

BACKGROUND

There are many houses with a two car garage that have never had two cars in them. Instead of using that space to shield cars from the sun and harsh weather, the garage has become home to a collection of gardening and lawn equipment, tools, woodworking equipment, cast-off furniture and things that are no longer used, but are not thrown away. Finding items that are needed in a cluttered garage is a complicated process. Usually, it starts with edging between the stacks of boxes and miscellaneous equipment. If the home owner is lucky, they may remember where this particular item was last, or which box it may be located. More often, it becomes a process of elimination that involves knowing what went into the garage during which time period and playing 'hot, hot, cold' until that person stumbles upon what they're trying to locate. Overhead garage storage can transform unused space in a garage into fully functional storage space. Whether looking to store holiday decorations, sports equipment or mementos, these items can easily fit in a garage if the proper storage racks are in place.

SUMMARY

In one embodiment, an overhead storage system is provided comprising a first adjustable mounting track having a ceiling mount, a first and second upper bracket mount fixed to the ceiling mount, a first and second lower hoop members and a lower hoop support member fixed to the first and second lower hoop members and parallel to the ceiling mount. The first and second upper bracket mounts are configured to receive the first and second lower hoop members. The first and second upper bracket mounts have a plurality of holes configured to align with holes of the first and second lower hoop members to vary the distance between the ceiling mount and the lower hoop support member.

The overhead storage system of the specified embodiment also includes a second adjustable mounting track having a ceiling mount, a first and second upper bracket mount fixed to the ceiling mount, a first and second lower hoop members and a lower hoop support member fixed to the first and second lower hoop members and parallel to the ceiling mount. The first and second upper bracket mounts are configured to receive the first and second lower hoop members. The first and second upper bracket mounts have a plurality of holes configured to align with holes of the first and second lower hoop members to vary the distance between the ceiling mount and the lower hoop support member.

Continuing with the embodiment described, the overhead storage system includes a first L-shaped side rail member and a second L-shaped side rail member, each having a first rail member and a second rail member removably connected together by a rail connector. The overhead storage system includes a first L-shaped frame rail member secured to the first L-shaped side rail member and the second L-shaped side rail member and a second L-shaped frame rail member secured to the first L-shaped side rail member and the second L-shaped side rail member. The first L-shaped side rail member, second L-shaped side rail member, first L-shaped frame rail member and second L-shaped frame rail member form a support surface. A drop-in grid member is configured to rest on the support surface.

BRIEF DESCRIPTION

Figure 1:
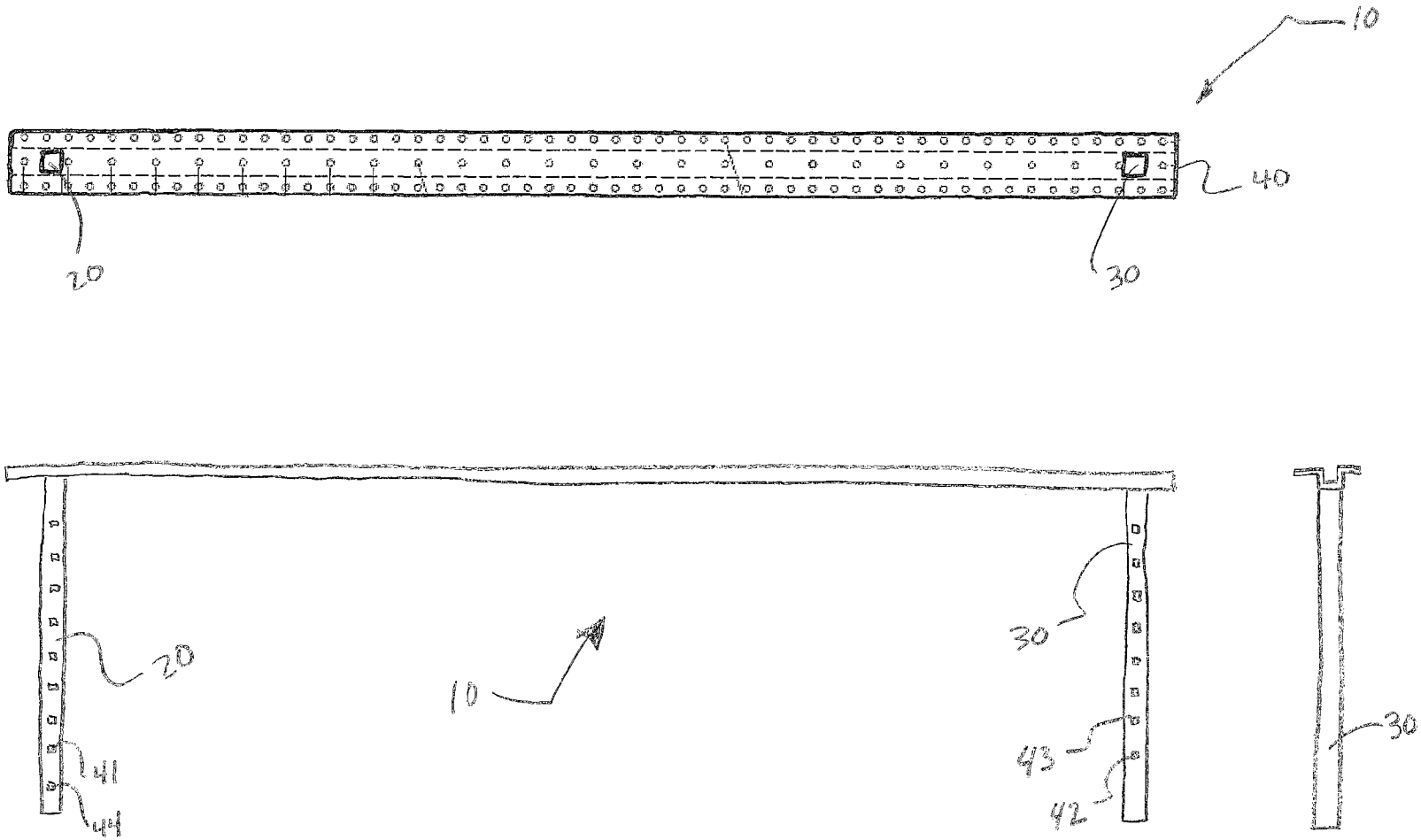
FIG. 1 shows an upper bracket mount.

FIG. 1 illustrates an upper bracket mount 10 in accordance with one aspect of the present invention. Upper bracket mount 10 is comprised of a left bracket mount member 20 and a right bracket mount member 30 and a ceiling mount 30. Left bracket mount member 20 and a right bracket mount member 30 are securely fastened to ceiling mount 30. In one embodiment, left bracket mount member 20 and a right bracket mount member 30 are welded to ceiling mount 30 to form a secure connection.

In one embodiment, ceiling mounting member 30 is configured to be secured to the ceiling of the garage. It should be appreciated that ceiling mount 30 may be attached to any surface that may be desired for mounting the modular overhead storage system.

Figure 2:
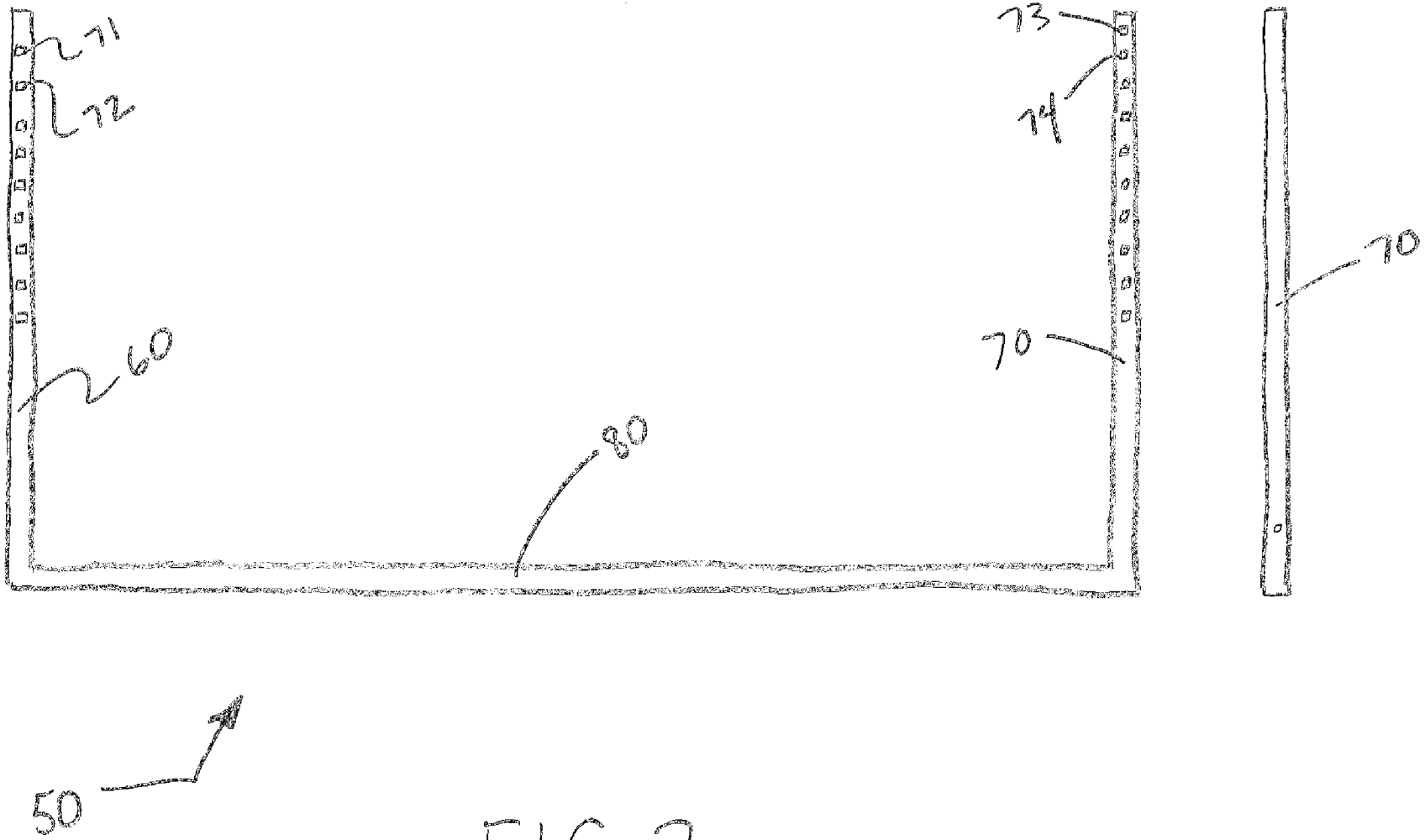
FIG. 2 illustrates a lower hoop assembly.

FIG. 2 illustrates a lower hoop assembly 50 in accordance with another aspect of the present invention. Lower hoop assembly 50 is comprised of a left lower hoop member 60, a right lower hoop member 70 and a lower hoop support member 80. Left lower hoop member 60 and right lower hoop member 70 are securely fastened to lower hoop support member 80. In the illustrated embodiment, left lower hoop member 60, right lower hoop member 70 and lower hoop support member 80 are formed of a continuous piece of material. In another embodiment, left hoop member 70 and a right bracket hoop member 30 are welded to lower hoop support member to form a secure connection.

Figure 8:
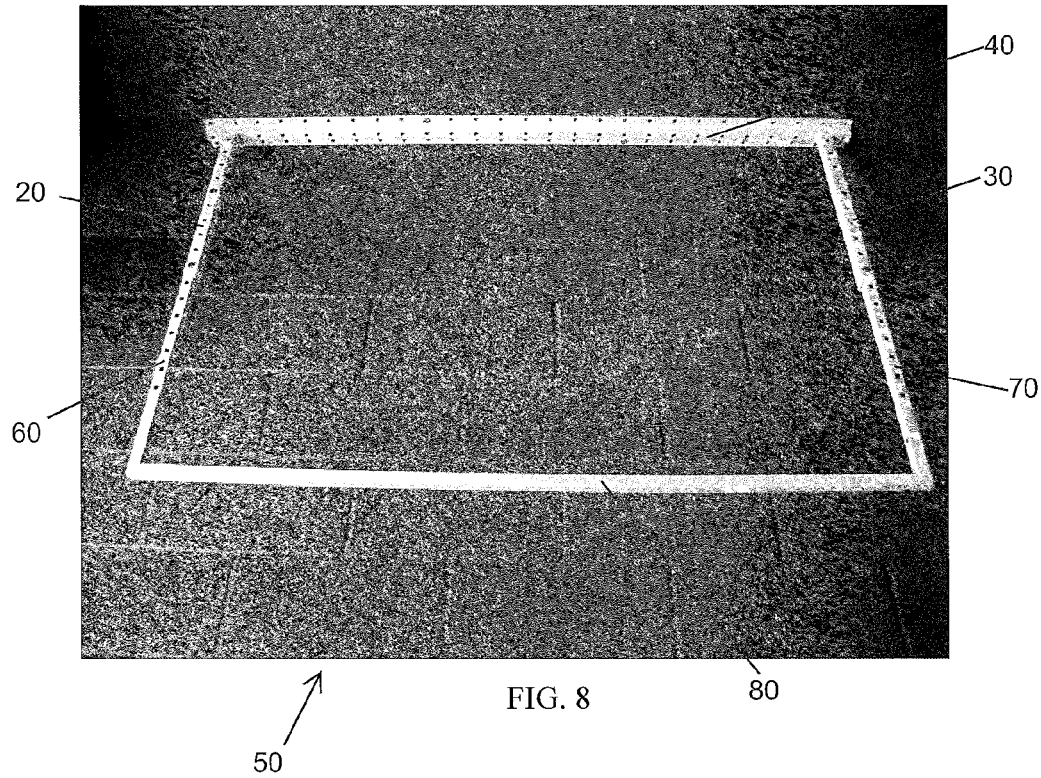
FIG. 8 shows the combination of a lower hoop and an upper bracket forming a mounting track.

In the illustrated embodiment, upper bracket mount 10 and lower hoop assembly 50 are configured to be removably joined together to form a mounting track, as shown in FIG. 8. The mounting track of the present invention forms the foundation for constructing the modular overhead storage system shown in FIG. 14.

In the illustrated embodiment, the left bracket mount member 20 and a right bracket mount member 30 and a ceiling mount 30 and the left lower hoop member 60 and right lower hoop member 70 are constructed of square tubing with a plurality of mounting holes 41, 42, 43, 44, 71, 72, 73, 74. The size of the opening in the square tubing of the left bracket mount member 20 and the right bracket mount member 30 is configured to be slightly larger than the size of the opening in the square tubing for the lower hoop member 60 and right lower hoop member 70. In this configuration, the left and right lower hoop members 60, 70 will slide into the opening of the left and right bracket mount members 20, 30 to vary the distance between the lower hoop member 60 and the ceiling mount 30. Such a configuration creates various sizing options for the mounting track between a storage surface and the ceiling of the structure.

Figure 3:
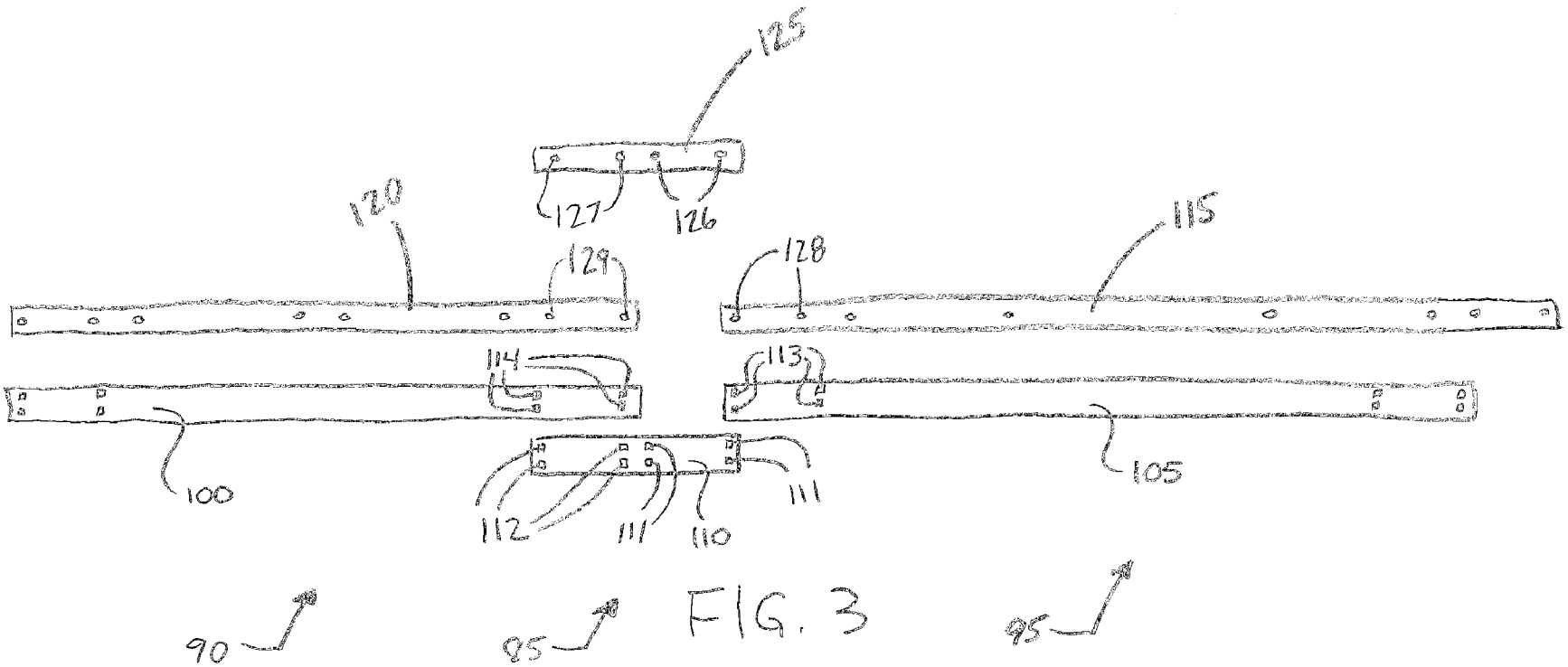
FIG. 3 illustrates a first and second universal side rail and a rail connector.

FIG. 3 illustrates a first side rail member 90, a second side rail member 95 and a rail connector 85 for securely fastening the two together so as to create a single rail member. In the illustrated example, first side rail member 90 has a length of 3 feet and second side rail member 95 has a length of four feet. Continuing with the illustrated example, the combination of the connector and the two side rail members creates a single side rail member having au overall length of 7 feet. The connector is designed such that the combination of the two pieces forming the 7 foot length is as strong and able to support the same weight as a single 7 foot piece without the connector. The first and second side rails may be of any length. The design of the side connector allows the manufacturer of the modular overhead storage system to ship varying lengths of side rail members so that the end user may create the configuration required for the particular installation.

In the embodiment illustrated FIG. 3, the first side rail member 90 has a side member 100 and a bottom member 120. The side member 100 has a plurality of side rail member holes 114. The bottom member 120 has a plurality of bottom rail member holes. The rail connector 85 has a side rail connector member 110 and a bottom rail connector member 125. The side rail connector member 110 has a plurality of side rail connector member holes 111, 112. The bottom rail connector member 125 has a plurality of bottom rail connector member holes 126, 127.

When assembled, first rail member 90 is configured to be attached to second rail member 95 using connector 85. More specifically, the plurality of side rail member holes 114 of side member 100 are configured to align with the side rail connector member holes 112 of the side 110 of rail connector 85. Similarly, the plurality of side rail member holes 113 of side member 105 are configured to align with the side rail connector member holes 111 of the side 110 of rail connector 85. On the bottom, the plurality of bottom rail member holes 129 of bottom rail member 120 are configured to align with the bottom rail connector member holes 127 of the bottom 125 of the rail connector 85. Similarly, the plurality of bottom rail member holes 128 of bottom rail member 115 are configured to align with the bottom rail connector member holes 126 of the bottom 125 of the rail connector 85. The connector 85 may be fixed to the first and second rail members 90, 95 using a nut and bolt combination fit through the aligned holes. It should be appreciated by one of ordinary skill in the art that any suitable fixing method may be used without departing from the intended scope of the present invention.

Figure 4:
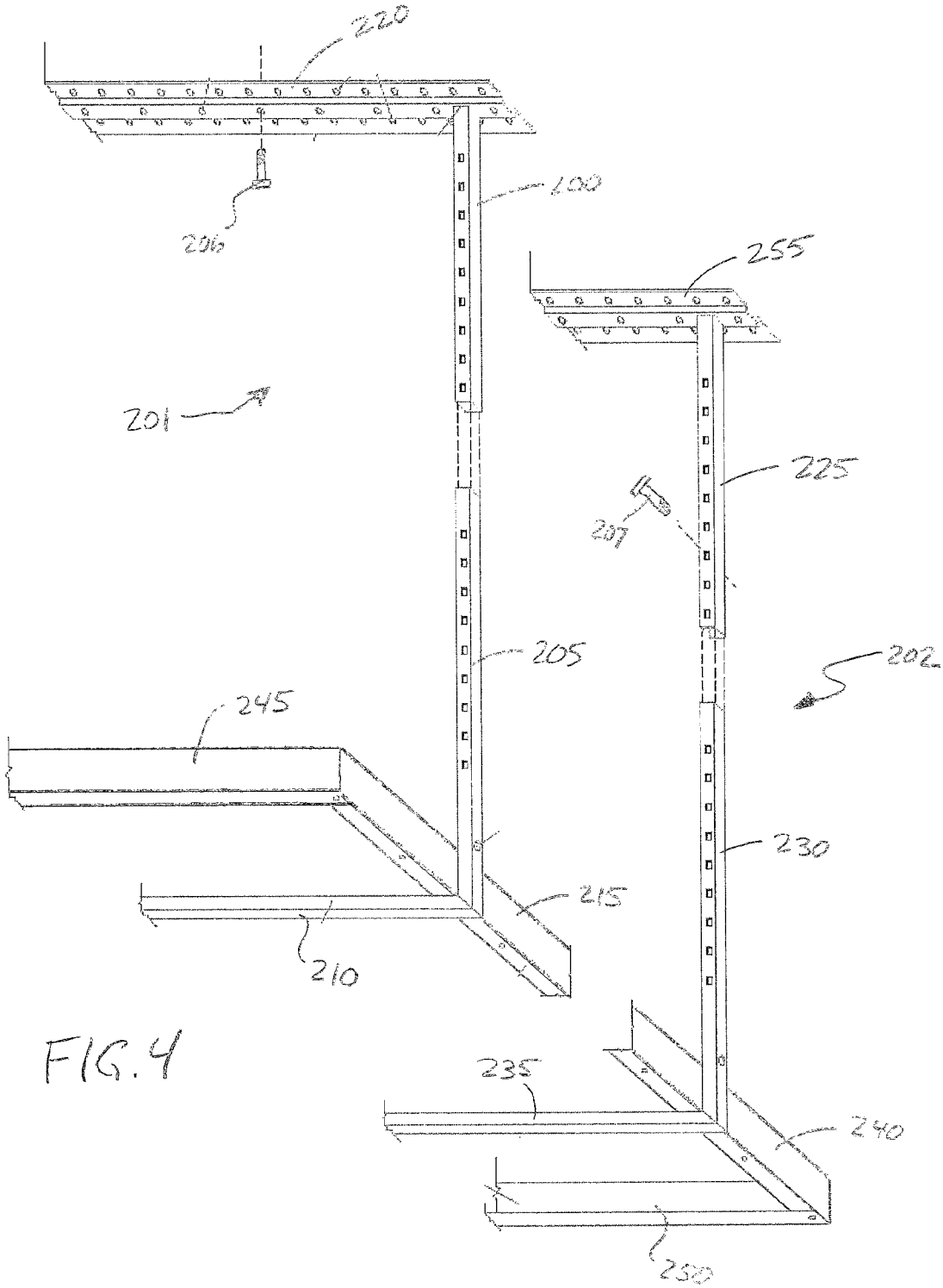
FIG. 4 shows a typical construction of a modular overhead storage system in accordance with one aspect of the present invention.

FIG. 4 illustrates a typical construction of a modular overhead storage system in accordance with one aspect of the present invention having a first mounting track 201 and a second mounting track 202 and a rail member 203. In the illustrated embodiment, the first mounting track is comprised of a ceiling mount 220 secured to an upper bracket member 200, a lower hoop member 205 and a lower hoop support member 210. The second mounting track is comprised of a ceiling mount 255 secured to an upper bracket member 225, a lower hoop member 230 and a lower hoop support member 235. The rail member 203 is comprised of a side rail 215 and a first frame rail 245 and a second frame rail 250. The side rail may be constructed of two side rail members connected together by a side rail connector (not shown). The rail member 203 is sized to fit within the first and second mounting tracks 201, 202 such that the mounting tracks "cradle" the rail member 203. In the illustrated embodiment, the ceiling mount 220 is secured to ceiling joists using one or more lag bolts 206 and the upper bracket member 200 is secured to the lower hoop member 205 using one or more carriage bolts 207.

Figure 5:
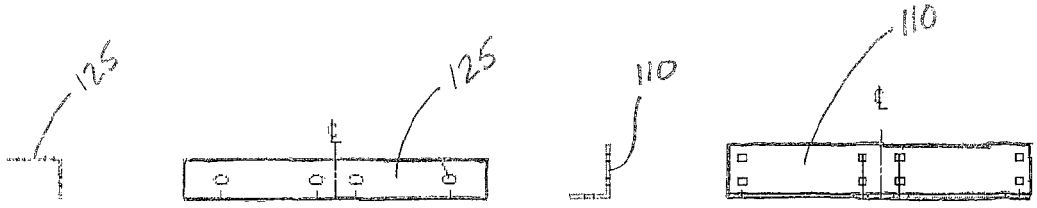
FIG. 5 shows one embodiment of a rail connector.

FIG. 5 shows one embodiment of the rail connector 85 in greater detail. Rail connector 85 has a side 110 and a bottom 125 with a plurality of holes disposed in each. The holes on the rail connector 85 are configured to attach a first side rail member to a second side rail member to create a single joined rail member that is designed to withstand the loads of a single rail member. In the illustrated embodiment, the load rating of the modular overhead storage system using the rail connector 85 is at least 750 lbs.

Figure 6:
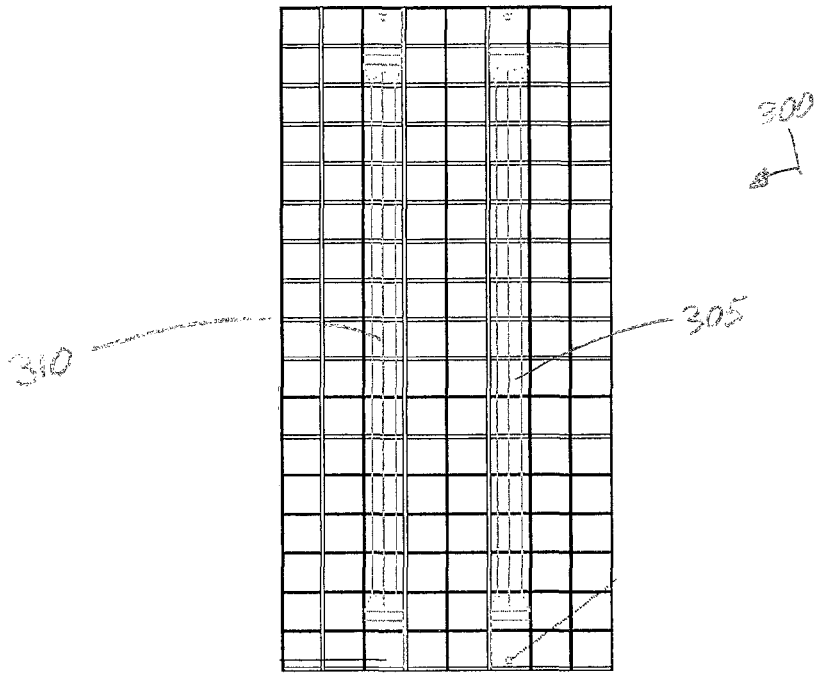
FIG. 6 illustrates a typical drop-in grid having grid stiffeners.
Figure 7:
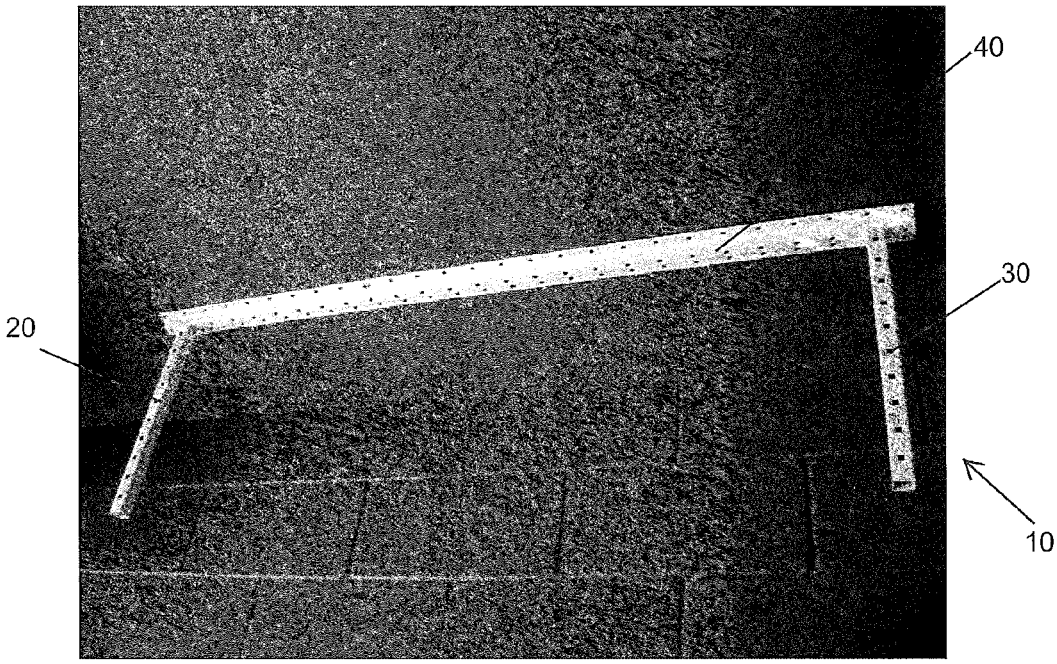
FIG. 7 illustrates one embodiment of a square tube upper bracket.

FIG. 6 shows the drop-in grid member 300 with a plurality of grid stiffeners 305, 310. Drop-in grid 300 is configured to be attached to rail member 203 so as to provide the surface for storing items. Drop-in grid is illustrated with a grid construction, however, one of ordinary skill in the art will appreciate that any suitable construction may be used for the item storage surface without departing from the scope and spirit of the present invention.

In the illustrated example of the modular overhead storage system shown in the photos of FIGS. 7-15, FIG. 7 shows the ceiling mount 40 of the upper bracket mount 10 fastened to the ceiling of a garage. Upper bracket 10 is comprised of a square tubed first and second mounting bracket 20, 30 for receiving the lower hoop 50. As shown in FIG. 8, the square tubed left and right lower hoop members 60, 70 of the lower hoop 50 slide within the square tubed first and second mounting bracket 20, 30 and fixed together by a plurality of carriage bolts. The combination of the upper bracket mount 10 and the lower hoop 50 together form the mounting track. The illustrated example uses square tubes to form the members, however, one of ordinary skill in the art will appreciate that alternate shapes of tubes may be used without departing from the intended scope of the invention.

Figure 9:
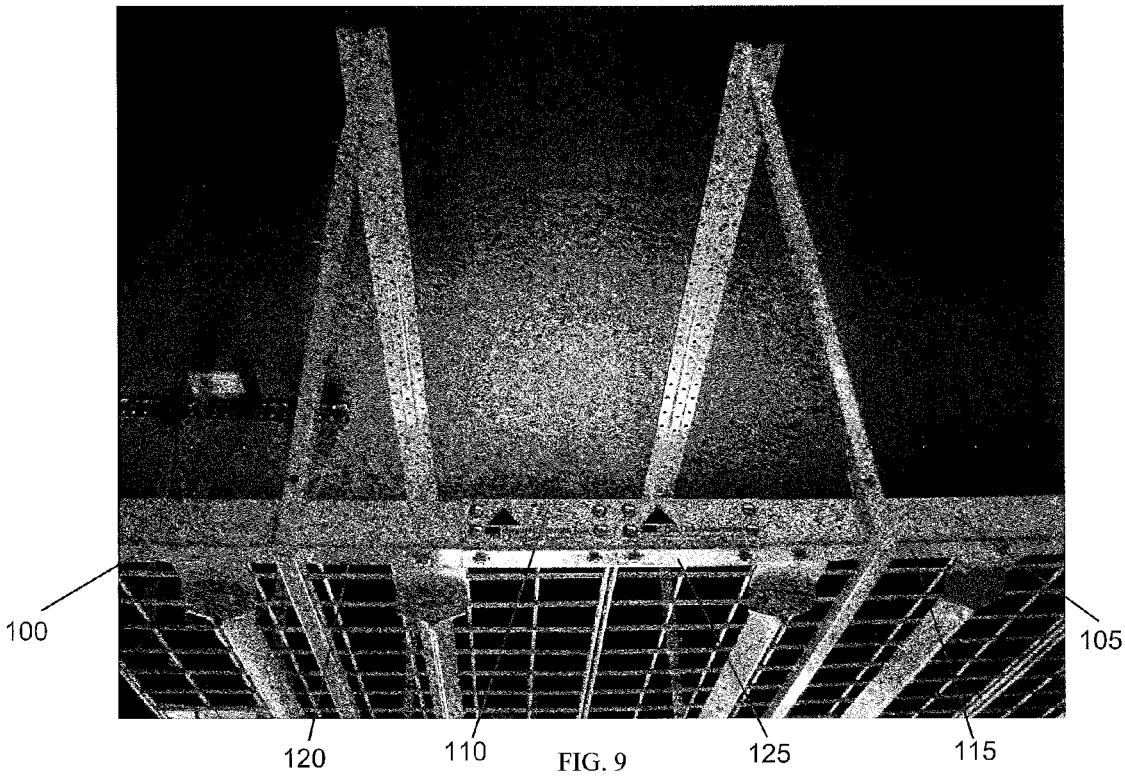
FIG. 9 shows one embodiment of a modular overhead storage system having a plurality of mounting tracks supporting a first and second universal side rail and a rail connector joined together by a rail connector.
Figure 10:
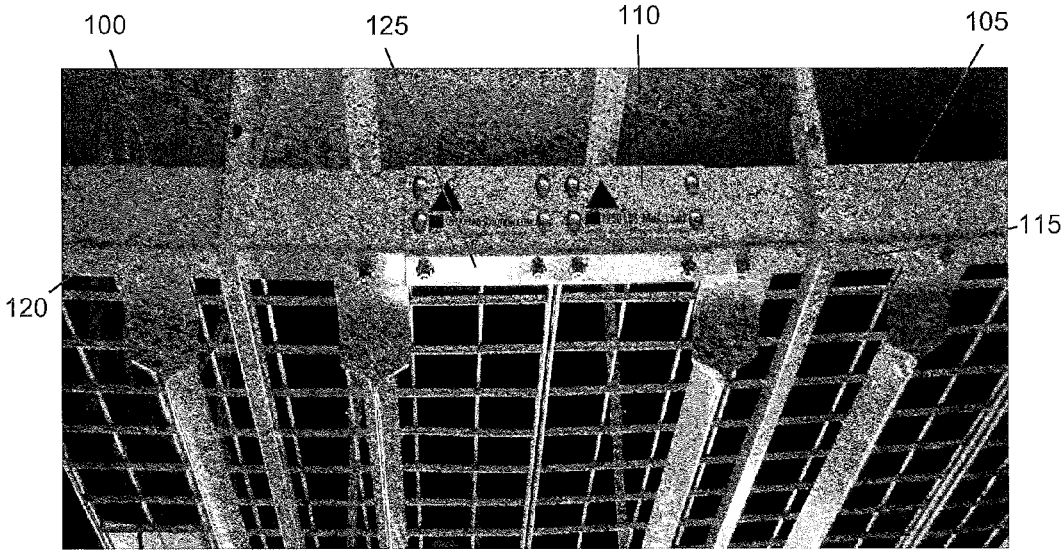
FIG. 10 illustrates the same modular overhead storage system of FIG. 9, showing the rail connector in greater detail.

FIGS. 9 and 10 show the combination of a side rail member and two mounting tracks. In the illustrated embodiment, the side rail member is comprised of a first side rail member 90 securely fixed to a second side rail member 95 using a rail connector 85. FIG. 9 shows the side 110 of the rail connector

85 and the sides 100, 105 of the first and second side rails 90, 95 respectively. FIG. 10 illustrates the bottom 125 of the rail connector 85 and the bottoms 115, 120 of the first and second side rails 90, 95 respectively. In one embodiment, the drop-in grid 300 is supported on all four sides by the bottoms 115, 120 of the first and second side rails 90, 95 respectively and the grid stiffeners 305, 310 are secured to the bottoms of the side rails.

Figure 11:
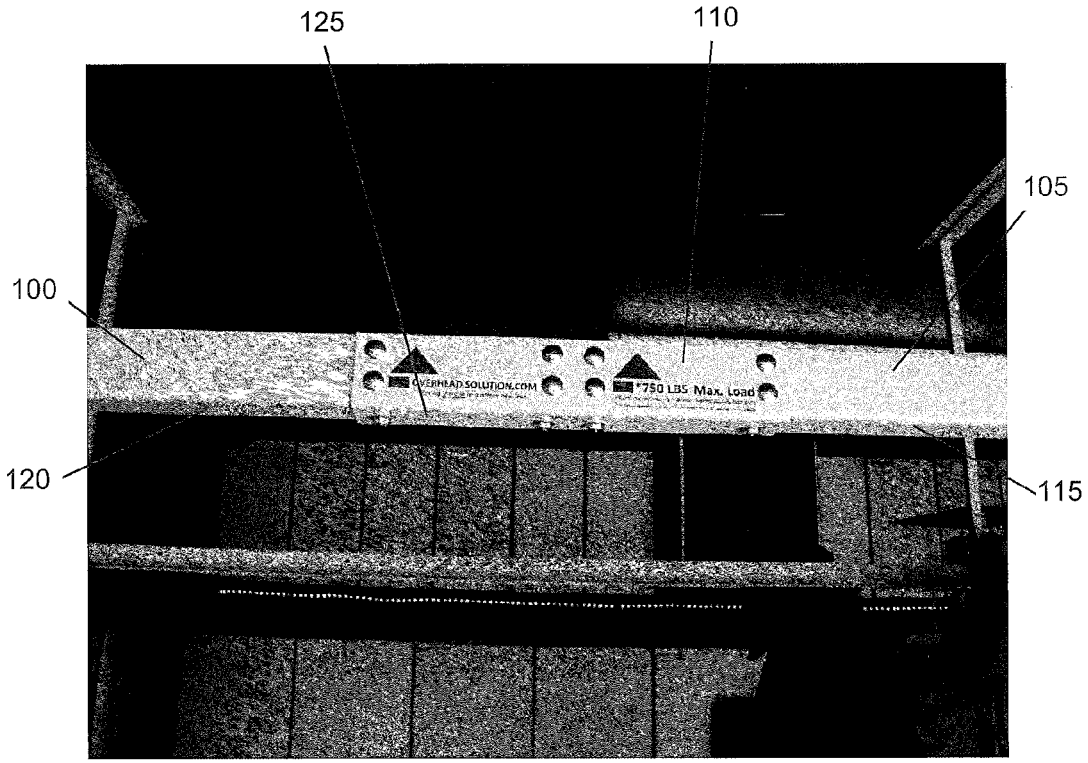
FIG. 11 illustrates one embodiment of the two side rails joined together by a rail connector.
Figure 12:
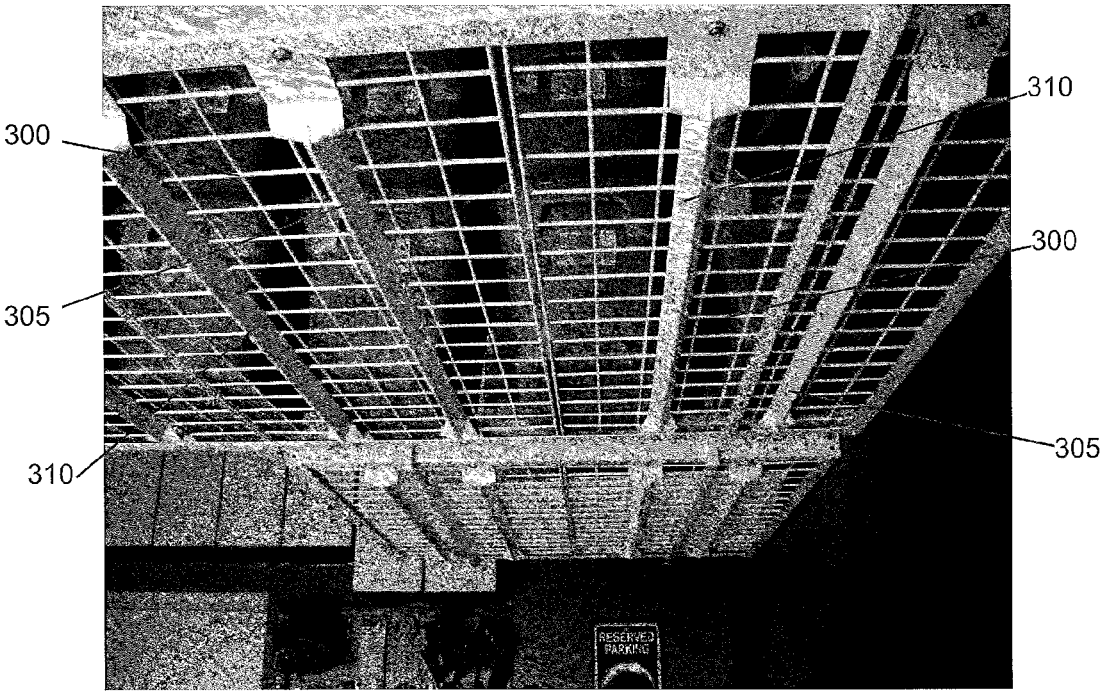
FIG. 12 shows one configuration of a number of drop-in grid members for an installed modular overhead storage system.

FIG. 11 shows a close up view of an installation having a first side rail member 100 securely attached to a second side rail member 105 using a rail connector 110. The first and second side rail members 100, 105 are shaped like an "L" to create a channel for supporting the drop-in grid member. As shown in FIG. 12, the drop-in grid member 300 rests within the L-shaped side rail members and the grid stiffeners are secured to the side rail members for additional security.

Figure 13:
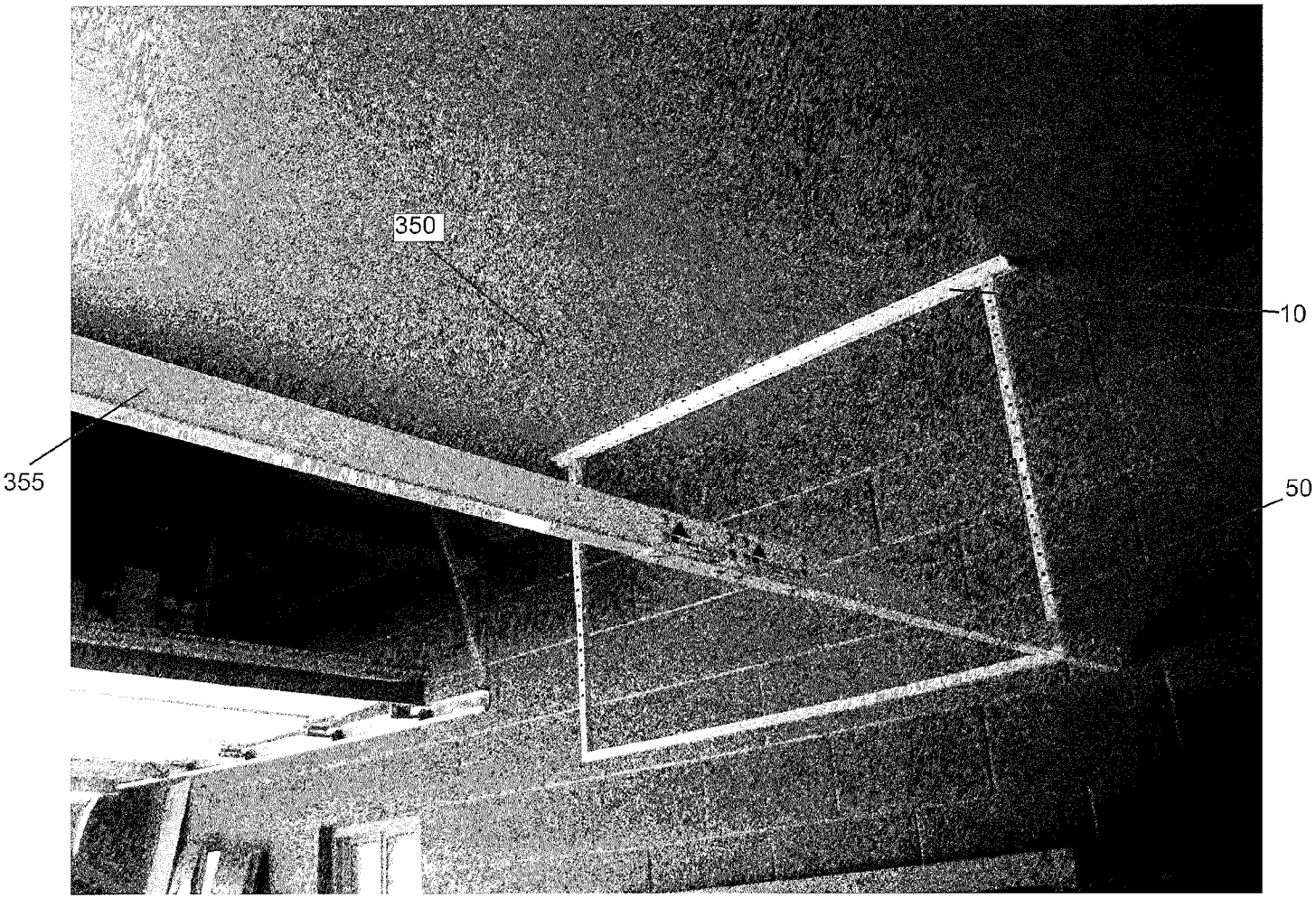
FIG. 13 illustrates the assembly of a mounting track and a side rail member comprising two side rails joined together by a rail connector.

FIG. 13 shows a mounting track 350 supporting a rail member 355. As shown previously, adjustable mounting track 350 is comprised of an upper bracket mount 10 and a lower loop 50. Typically, the adjustable mounting track is adjustable between from 18" to 36" to account for the vehicle within the garage. However, one skilled in the art will understand that distance may be varied for higher joists without departing from the scope of the present invention. In the illustrated embodiment, rail member 355 is an "L" shaped member having a first rail member 90 and a second rail member 95 connected together by a rail connector 85. Multiple rail members and mounting tracks may be used depending upon the configuration of the location.

Figure 14:
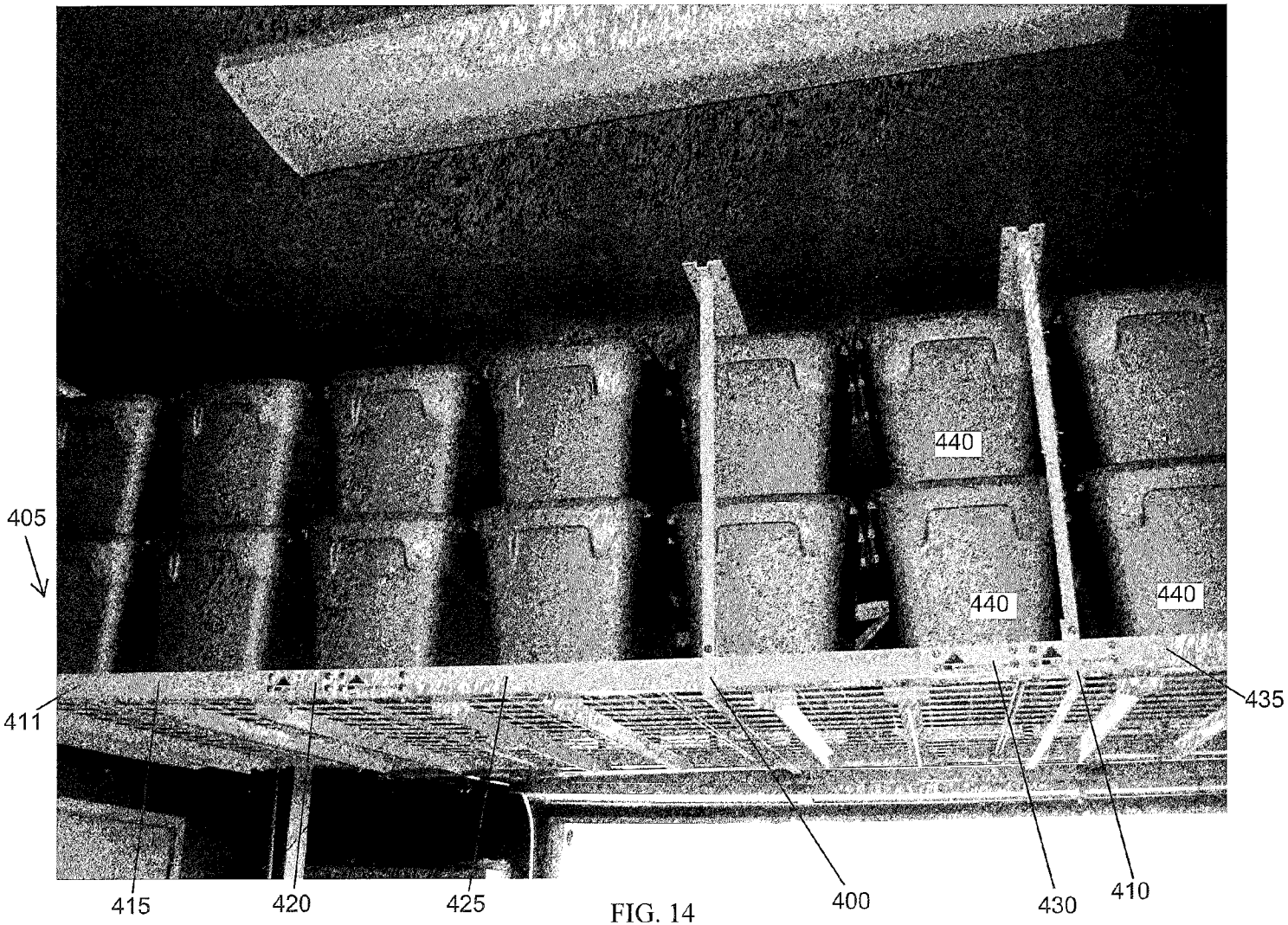
FIG. 14 illustrates a one embodiment of a modular overhead storage system supporting a number of items.
Figure 15:
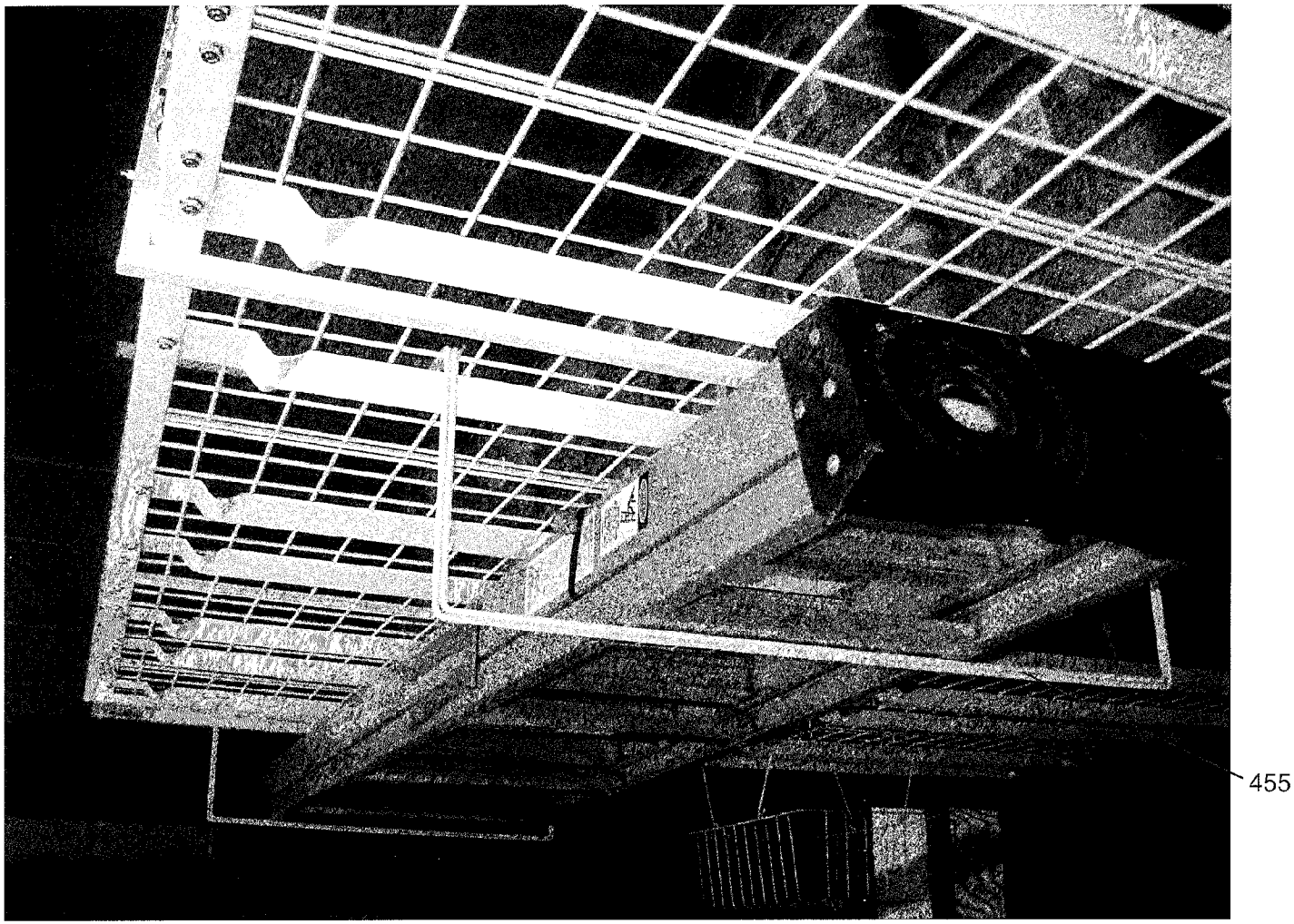
FIG. 15 shows a modular overhead storage system having a ladder hanger.

FIG. 14 shows one particular example of a modular overhead storage system in accordance with the present invention. The modular overhead storage system 405 is comprised of a number of mounting tracks 400, 410 (others are not shown in the figure) and a multi-sectioned rail member 411. Multi-sectioned rail member 411 is comprised of rail sections 415, 425, 435 joined together by rail connectors 420, 430. Drop-in grid 300 is supported by the "L" shape of the multi-sectioned rail member 411 and secured by fastening the grid stiffeners 305, 310 to the rail member. Items 440 rest on top of the drop-in grid 300. As shown in FIG. 15, hooks or ladder hangers may be attached to the drop-in grid to allow additional storage.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

It should be appreciated that reference throughout this specification to "one embodiment" or "an embodiment" or "one example" or "an example" means that a particular feature, structure or characteristic described in connection with the embodiment may be included, if desired, in at least one embodiment of the present invention. Therefore, it should be appreciated that two or more references to "an embodiment" or "one embodiment" or "an alternative embodiment" or "one example" or "an example" in various portions of this specification are not necessarily all referring to the same embodiment. Furthermore, the particular features, structures or characteristics may be combined as desired in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects.

While the invention has been particularly shown and described with reference to various embodiments thereof, it will be understood by those skilled in the art that various other changes in the form and details may be made without departing from the spirit and scope of the invention.

We claim:

1. A modular overhead storage system comprising:

a first adjustable mounting track having a first ceiling mount, a first and second upper bracket mount fixed to the first ceiling mount, first and second lower hoop members and a first lower hoop support member fixed to the first and second lower hoop members and parallel to the first ceiling mount, the first and second upper bracket mounts configured to receive the first and second lower hoop members, the first and second upper bracket mounts having a plurality of holes configured to align with holes of the first and second lower hoop members to vary the distance between the first ceiling mount and the first lower hoop support member;

a second adjustable mounting track having a second ceiling mount, a third and fourth upper bracket mount fixed to the second ceiling mount, third and fourth lower hoop members and a second lower hoop support member fixed to the third and fourth lower hoop members and parallel to the second ceiling mount, the third and fourth upper bracket mounts configured to receive the third and fourth lower hoop members, the third and fourth upper bracket mounts having a plurality of holes configured to align with holes of the third and fourth lower hoop members to vary the distance between the second ceiling mount and the second lower hoop support member;

a first L-shaped side rail member having a first rail member and a second rail member removably connected together by a first rail connector;

a second L-shaped side rail member having a third rail member and a fourth rail member removably connected together by a second rail connector;

a first L-shaped frame rail member secured to the first L-shaped side rail member and the second L-shaped side rail member;

a second L-shaped frame rail member secured to the first L-shaped side rail member and the second L-shaped side rail member, wherein the first L-shaped side rail member, second L-shaped side rail member, first L-shaped frame rail member and second L-shaped frame rail member form a support surface, said support surface configured to be positioned on the first and second lower hoop support members;

a drop-in grid member configured to rest on the support surface.

* * * * *